US010151042B2

(12) United States Patent
Usui et al.

(10) Patent No.: US 10,151,042 B2
(45) Date of Patent: Dec. 11, 2018

(54) COATING FORMING DEVICE AND COATING FORMING METHOD FOR FORMING METAL COATING

(71) Applicant: TOYOTA JIDOSHA KABUSHIKI KAISHA, Toyota-shi, Aichi-ken (JP)

(72) Inventors: Hiroki Usui, Toyota (JP); Hiroshi Yanagimoto, Miyoshi (JP); Motoki Hiraoka, Toyota (JP); Yuki Sato, Nissin (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/064,226

(22) Filed: Mar. 8, 2016

(65) Prior Publication Data

US 2016/0265128 A1 Sep. 15, 2016

(30) Foreign Application Priority Data

Mar. 11, 2015 (JP) ..... 2015-048005

(51) Int. Cl.
*C25D 17/14* (2006.01)
*C25D 5/06* (2006.01)
(Continued)

(52) U.S. Cl.
CPC ..... *C25D 5/02* (2013.01); *C25D 3/00* (2013.01); *C25D 5/22* (2013.01); *C25D 17/00* (2013.01); *C25D 17/002* (2013.01); *C25D 17/14* (2013.01)

(58) Field of Classification Search
CPC ..... C25D 5/06; C25D 17/14
See application file for complete search history.

(56) References Cited

U.S. PATENT DOCUMENTS 4,326,930 A 4/1982 Nagel et al.
6,375,823 B1 4/2002 Matsuda et al.
(Continued)

FOREIGN PATENT DOCUMENTS

CN 104011269 A 8/2014
JP 55-138892 A 10/1980
(Continued)

OTHER PUBLICATIONS

Notice of Allowance dated Jan. 9, 2018, issued by the United States Patent and Trademark Office in U.S. Appl. No. 14/371,036.
(Continued)

*Primary Examiner* — Bryan D. Ripa
(74) *Attorney, Agent, or Firm* — Sughrue Mion, PLLC

(57) ABSTRACT

A coating forming device for forming a metal coating on a surface of a substrate includes: an anode; a power supply; and a solid electrolyte membrane disposed between the anode and the substrate and contains metal ions. The solid electrolyte membrane includes: a contact surface that is a region contacting a coating-forming region where the metal coating is formed; and a concave portion recessed relative to the contact surface such that, when the contact surface contacts the coating-forming region, the solid electrolyte membrane is not in contact with a portion of the surface of the substrate excluding the coating-forming region. The metal ions are reduced to form the metal coating on the coating-forming region by the power supply applying a voltage between the anode and the substrate.

9 Claims, 6 Drawing Sheets

(51) Int. Cl.

| | |
|---|---|
| ***C25D 5/02*** | (2006.01) |
| ***C25D 5/22*** | (2006.01) |
| ***C25D 17/00*** | (2006.01) |
| ***C25D 3/00*** | (2006.01) |

(56) References Cited

U.S. PATENT DOCUMENTS

| | | | | |
|---|---|---|---|---|
| 7,943,019 | B2 | 5/2011 | Otogawa et al. | |
| 2002/0134674 | A1 | 9/2002 | Andrews et al. | |
| 2008/0217182 | A1 | 9/2008 | Dai | |
| 2009/0050487 | A1* | 2/2009 | Fang | B23H 3/00 205/135 |
| 2010/0230278 | A1 | 9/2010 | Taruya et al. | |
| 2011/0147202 | A1 | 6/2011 | Haryu et al. | |
| 2011/0180398 | A1 | 7/2011 | Nakazawa et al. | |
| 2011/0180416 | A1 | 7/2011 | Kurashima et al. | |
| 2015/0014178 | A1* | 1/2015 | Hiraoka | C25D 5/08 205/261 |

FOREIGN PATENT DOCUMENTS

| | | | | |
|---|---|---|---|---|
| JP | 1-165786 | A | 6/1989 | |
| JP | 5-70986 | A | 3/1993 | |
| JP | 5-148681 | A | 6/1993 | |
| JP | 2005133187 | A | 5/2005 | |
| JP | 2010-37622 | A | 2/2010 | |
| JP | 2012-219362 | A | 11/2012 | |
| JP | WO 2013125643 | A1 * | 8/2013 | C25D 5/08 |
| JP | 5605517 | B2 | 10/2014 | |

OTHER PUBLICATIONS

Communication dated Jan. 17, 2017, issued by the United States Patent and Trademark Office in U.S. Appl. No. 14/371,036.

Notice of Allowance dated Sep. 20, 2017, issued by the United States Patent and Trademark Office in U.S. Appl. No. 14/371,036.

Akamatsu et al., "Fabrication of Silver Patterns on Polyimide Films Based on Solid-Phase Electrochemical Constructive Lithography Using Ion-Exchangeable Precursor Layers," Langmuir, vol. 27, pp. 11761-11766, 2011 (6 pages total).

Schmidt et al., "Copper Electrodeposition on Glassy Carbon from A Solid Electrolyte", Electrochimica Acta,1993, pp. 577-580, vol. 38, No. 4 (4 pages total).

Communication dated Jun. 4, 2018, issued by the U.S. Patent and Trademark Office in U.S. Appl. No. 14/371,036.

Communication dated Jul. 18, 2018 from the U.S. Patent and Trademark Office in counterpart U.S. Appl. No. 14/371,036.

* cited by examiner

COATING FORMING DEVICE AND COATING FORMING METHOD FOR FORMING METAL COATING

INCORPORATION BY REFERENCE

The disclosure of Japanese Patent Application No. 2015-048005 filed on Mar. 11, 2015 including the specification, drawings and abstract is incorporated herein by reference in its entirety.

BACKGROUND OF THE INVENTION

1. Field of the Invention

The present invention relates to a coating forming device and a coatingd forming method for forming a metal coating on a surface of a substrate and, in particular, relates to a coating forming device and a coating forming method for forming a metal coating, in which a metal coating can be suitably formed by applying a voltage between an anode and a substrate.

2. Description of Related Art

In the related art, there is a case where a metal coating is formed on a surface of a substrate by depositing metal ions thereon. For example, as a technique of forming such a metal coating, a technique of forming a metal coating by plating such as electroless plating; and a technique of forming a metal coating using a PVD method such as sputtering are disclosed.

However, in a case where plating such as electroless plating is performed, a washing process is necessary after the plating, and a process of treating a waste liquid used during the washing process is also necessary. In addition, in a case where a metal coating is formed on a surface of a substrate using a PVD method such as sputtering, internal stress is generated in the formed metal coating. Therefore, the PVD method has a limit in increasing the thickness of a metal coating, and particularly in the case of sputtering, a metal coating can be formed only in a high vacuum environment.

In consideration of the above-described points, for example, a coating forming device for forming a metal coating is disclosed, the coating forming device including: an anode; a solid electrolyte membrane that is disposed between the anode and a substrate (cathode); a power supply that applies a voltage between the anode and the cathode (substrate) (for example, refer to Japanese Patent No. 5605517).

According to this coating forming device, a metal coating can be formed on a surface of a metal substrate by making the solid electrolyte membrane containing metal ions into contact with the surface of the substrate and causing the power supply to apply a voltage between the anode and the cathode (metal substrate) to deposit the metal ions on the surface of the metal substrate.

Here, when the metal coating is partially formed on the surface of the substrate using the above-described coating forming device, the following anode is used. Specifically, the surface of the anode contacting the solid electrolyte membrane includes: a coating-forming surface that has a shape corresponding to a coating-forming region of the substrate; and a non-coating-forming surface other than the coating-forming surface, and metal of the coating-forming surface has a lower oxygen overvoltage than metal of the non-coating-forming surface.

With the above-described configuration, metal of the coating-forming surface has a lower oxygen overvoltage than metal of the non-coating-forming surface. Therefore, the reactivity of deposition of metal ions on metal in a region between the coating-forming surface of the anode and the substrate can increase. As a result, metal can be deposited on the coating-forming region of the substrate opposite to the coating-forming surface. In this way, a metal coating can be formed in a pattern corresponding to the coating-forming surface without, for example, masking the surface of the substrate.

SUMMARY OF THE INVENTION

However, in the anode of the coating forming device disclosed in Japanese Patent No. 5605517, the solid electrolyte membrane is interposed between the anode and the substrate. Therefore, the metal ions impregnated into a portion of the solid electrolyte membrane contacting the coating-forming surface are diffused into a portion of the solid electrolyte membrane contacting the non-coating-forming surface. As a result, metal ions are reduced and deposited on a portion of the non-coating-forming surface near the coating-forming region of the substrate, and thus an edge portion (boundary portion) of the metal coating is unclear.

The invention provides a coating forming device and a coating forming method for forming a metal coating, in which a metal coating having a conspicuous edge portion can be partially formed on a substrate at a low cost.

The first aspect of the invention provides a coating forming device for forming a metal coating on a surface of a substrate. The coating forming device includes: an anode; a power supply that applies a voltage between the anode and the substrate; and a solid electrolyte membrane that is disposed between the anode and the substrate and contains metal ions. The solid electrolyte membrane includes: a contact surface that is a region contacting a coating-forming region, the coating-forming region being a region of a surface of the substrate where the metal coating is formed; and a concave portion that is recessed relative to the contact surface such that, when the contact surface contacts the coating-forming region, the solid electrolyte membrane is not in contact with a portion of the surface of the substrate excluding the coating-forming region. The metal ions is reduced to form the metal coating on the coating-forming region by the power supply applying a voltage between the anode and the substrate in a state where the contact surface is in contact with the substrate.

According to the first aspect, the contact surface of the solid electrolyte membrane contacts the coating-forming region of the substrate in a state where the solid electrolyte membrane is in contact with the substrate. Concurrently, the concave portion of the solid electrolyte membrane is opposite to a portion of the surface of the substrate excluding the coating-forming region (that is, a non-coating-forming region of the substrate where the metal coating is not formed), and the solid electrolyte membrane is not in contact with the non-coating-forming region.

When a voltage is applied between the anode and the cathode (substrate) in the above-described state, the metal ions contained in the solid electrolyte membrane moves to the coating-forming region (surface) of the substrate contacting the solid electrolyte membrane and are reduced on the coating-forming region of the substrate. As a result, metal derived from the metal ions is deposited. On the other hand, the solid electrolyte membrane is not in contact with the non-coating-forming region of the substrate opposite to the concave portion of the solid electrolyte membrane.

Therefore, metal is not deposited on the non-coating-forming region. As a result, a metal coating having a conspicuous edge portion can be formed on the coating-forming region of the substrate. Further, a solid electrolyte membrane that contacts the substrate only with the coating-forming region of the substrate can be prepared by providing the concave portion to the solid electrolyte membrane. Therefore, a metal coating can be formed on the coating-forming region having a complicate shape.

In the first aspect, water repellency of a surface of the concave portion may be higher than water repellency of the contact surface.

According to the above aspect, water near the concave portion of the solid electrolyte membrane is likely to move to a region near the contact surface. Therefore, water is gathered near the contact surface 13*a* of the solid electrolyte membrane. Therefore, the metal ions are likely to move to the region near the contact surface and the reduction reaction of the metal ions (deposition of metal) on the contact surface can be smoothly performed. As a result, the deposition of metal on the coating-forming region of the substrate contacting the contact surface is promoted.

In the first aspect, the surface of the concave portion may include an inclined surface that is inclined relative to the contact surface such that a depth of the concave portion increases from an edge portion of the contact surface toward an inside of the concave portion.

According to the above aspect, by providing the inclined surface on the surface of the concave portion as described above, the metal ions and water in the solid electrolyte membrane are likely to flow near the contact surface of the solid electrolyte membrane. Therefore, the metal coating can be more efficiently formed on the coating-forming region of the substrate.

In the above aspect, when the solid electrolyte membrane is pressed against the metal coating, the metal coating pushes the solid electrolyte membrane up along with an increase in the thickness of the metal coating during the formation of the metal coating. Due to this pushing pressure, the pressure at which the solid electrolyte membrane presses the metal coating increases.

The first aspect may further include: a pressing unit configured to press the solid electrolyte membrane toward the substrate; a pressure measuring unit configured to measure a pressure at which the solid electrolyte membrane presses the substrate; and a controller configured to control the pressing unit such that a pressure measured by the pressure measuring unit is constant during a formation of the metal coating.

According to the above aspect, the metal coating can be formed while controlling the pressure, at which the substrate is pressed toward the solid electrolyte membrane, to be constant. Therefore, the shape of the contact surface of the solid electrolyte membrane can be maintained without the solid electrolyte membrane pressing the substrate at an excessive pressure. As a result, the solid electrolyte membrane can be prevented from protruding from the coating-forming region of the substrate, and contacting to the non-coating-forming region. Therefore, a metal coating having a conspicuous edge portion can be formed.

According to a second aspect of the invention, there is a coating forming method for forming a metal coating. The coating forming method according to the second aspect includes: contacting a solid electrolyte membrane toward a substrate, the solid electrolyte membrane containing metal ions and being disposed between an anode and the substrate; and forming the metal coating on a surface of the substrate by applying a voltage between the anode and the substrate to reduce the metal ions. The solid electrolyte membrane includes a contact surface and a concave portion, and the concave portion being recessed relative to the contact surface such that, when the contact surface contacts a coating-forming region of the surface of the substrate where the metal coating is formed, the solid electrolyte membrane is not in contact with a portion of the surface of the substrate excluding the coating-forming region.

According to the second aspect, the contact surface of the solid electrolyte membrane contacts the coating-forming region of the substrate in a state where the solid electrolyte membrane is in contact with the substrate. The concave portion of the solid electrolyte membrane is opposite to a non-coating-forming region of the substrate where the metal coating is not formed, and the solid electrolyte membrane is not in contact with the this non-coating-forming region.

When a voltage is applied between the anode and the cathode (substrate) in the above-described state, the metal ions contained in the solid electrolyte membrane moves to the coating-forming region (surface) of the substrate contacting the solid electrolyte membrane. As a result, metal derived from the metal ions are deposited. On the other hand, the solid electrolyte membrane is not in contact with the non-coating-forming region of the substrate opposite to the concave portion of the solid electrolyte membrane. Therefore, metal is not deposited on the non-coating-forming region. As a result, a metal coating having a conspicuous edge portion can be formed on the coating-forming region of the substrate.

In the second aspect, water repellency of a surface of the concave portion may be higher than water repellency of the contact surface.

According to the above aspect, water near the concave portion of the solid electrolyte membrane is likely to move to a region near the contact surface. Therefore, water is gathered near the contact surface 13*a* of the solid electrolyte membrane. Therefore, the metal ions are likely to move to the region near the contact surface and the reduction reaction of the metal ions (deposition of metal) on the contact surface can be smoothly performed. As a result, the deposition of metal on the coating-forming region of the substrate contacting the contact surface is promoted.

In the second aspect, the surface of the concave portion may include an inclined surface that is inclined relative to the contact surface such that a depth of the concave portion increases from an edge portion of the contact surface toward an inside of the concave portion, and the substrate is disposed below the solid electrolyte membrane during a formation of the metal coating.

According to the above aspect, by providing the inclined surface on the surface of the concave portion as described above, the metal ions and water in the solid electrolyte membrane are likely to flow near the contact surface of the solid electrolyte membrane. Therefore, the metal coating can be more efficiently formed on the coating-forming region of the substrate.

In the second aspect, the substrate may be pressed toward the solid electrolyte membrane during a formation of the metal coating, and a pressure at which the substrate is pressed toward the solid electrolyte membrane may be controlled to be constant during the formation of the metal coating.

According to the above aspect, irrespective of an increase in the thickness of the metal coating during the formation of the metal coating, the metal coating can be formed while controlling the pressure, at which the substrate is pressed toward the solid electrolyte membrane, to be constant. Therefore, the solid electrolyte membrane does not press the substrate at an excessive pressure, and thus the shape of the contact surface of the solid electrolyte membrane can be maintained. As a result, the solid electrolyte membrane can be prevented from protruding from the coating-forming region of the substrate, and contacting to the non-coating-forming region. Therefore, a metal coating having a conspicuous edge portion can be formed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, an coating forming device which can suitably perform coating forming methods for forming a metal coating according to two embodiments of the invention will be described.

Figure 1:
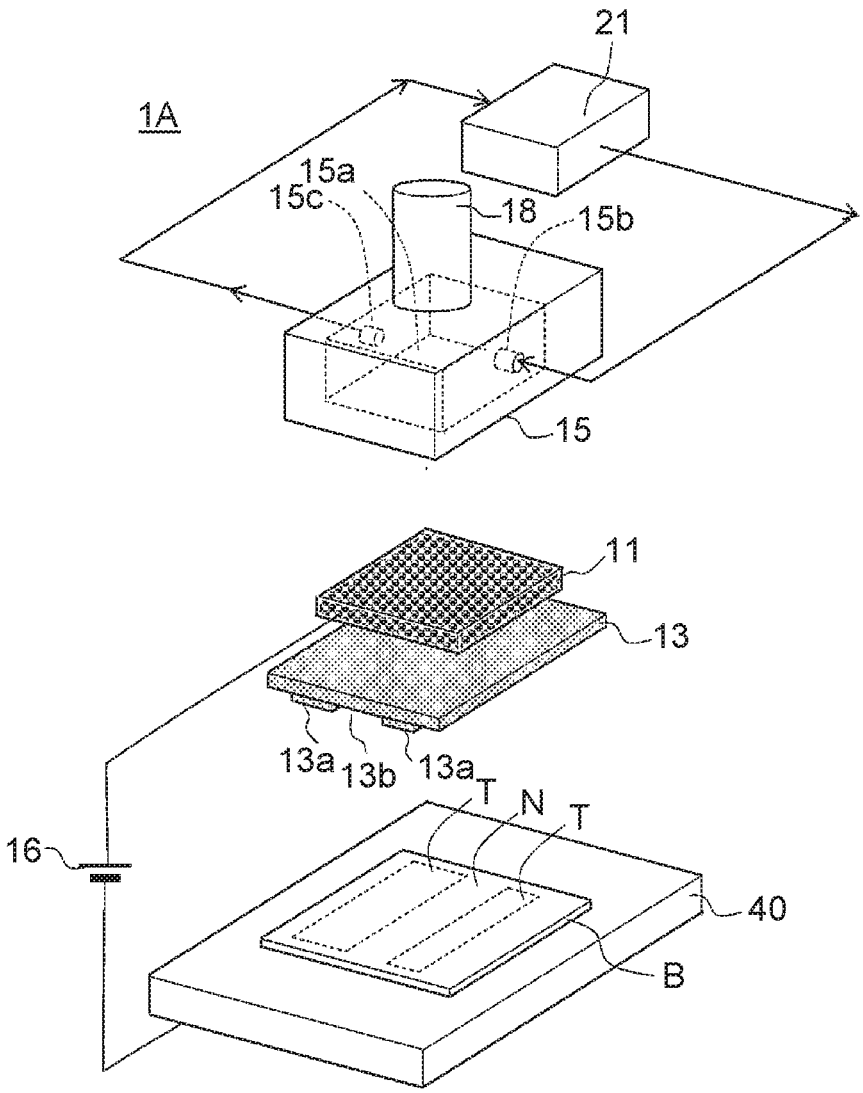
FIG. 1 is an exploded schematic diagram showing a coating forming device for forming a metal coating according to a first embodiment of the invention.

A coating forming device 1A and a coating forming method for forming a metal coating according to a first embodiment of the invention will be described with reference to FIGS. 1 to 3C. As shown in FIG. 1, in the coating forming device 1A according to the first embodiment, metal is deposited by reducing metal ions, and a metal coating formed of the deposited metal is partially formed on a surface of a substrate B. In the first embodiment, the coating forming device 1A forms a metal coating on two coating-forming regions T, T of the surface of the substrate B.

The substrate B is not particularly limited as long as a surface thereof where a metal coating is formed (that is, a conductive surface) functions as a cathode. The substrate B may be formed of a metal material such as aluminum or iron or may be obtained by forming a metal layer such as copper, nickel, silver, or iron on a surface of a resin, a ceramic, or the like.

The coating forming device 1A includes: an anode 11 that is formed of a metal; a solid electrolyte membrane 13 that is disposed between the anode 11 and the substrate B (cathode); and a power supply 16 that applies a voltage between the anode 11 and the substrate B.

In the embodiment, a placing table 40 formed of a metal on which the substrate B is placed is provided. A negative electrode of the power supply 16 is connected to the placing table 40, and a positive electrode of the power supply 16 is connected to the anode 11. Here, the placing table 40 and the surface of the substrate B where the metal coating is formed (at least the coating-forming region T) are electrically connected to each other. As a result, the surface of the substrate B can function as the cathode. As long as the surface of the substrate B can be connected to the negative electrode of the power supply 16, the placing table 40 is not necessarily provided or a non-conductive placing table may be provided instead of the placing table 40.

Further, in the embodiment, the coating forming device 1A includes a housing 15. A housing concave portion 15*a* that houses the anode 11 is formed blow the housing 15. The solid electrolyte membrane 13 is attached to the bottom surface of the housing 15 such that the housing concave portion 15*a* is sealed in a state where the housing concave portion 15*a* houses the anode 11. As a result, a container 12 that contains a metal solution L can be formed such that the metal solution L contacts a surface of the solid electrolyte membrane 13 opposite to the surface thereof contacting the substrate B.

In the embodiment, the anode 11 may be movable to a porous body side 14 relative to the housing concave portion 15*a*. As a result, in a case where a porous anode (soluble anode) formed of the same material as that of the metal coating is used as the anode 11, even when the anode 11 is dissolved and consumed during the formation of the metal coating, the anode 11 moves due to the weight of the anode 11, and the surface of the substrate B can be pressed by the solid electrolyte membrane 13 due to the weight of the anode 11. On the other hand, in a case where the anode 11 is fixed to the housing concave portion 15*a*, the surface of the substrate B can be more uniformly pressed by a pressing unit 18 described below through the solid electrolyte membrane 13.

In the embodiment, in the housing 15, a supply path 15*b*, through which the metal solution L is supplied to the housing 15, is formed on one side of the housing concave portion 15*a* to be connected to the housing concave portion 15*a*. A discharge path 15*c*, through which the metal solution L is discharged from the housing 15, is formed on the other side of the housing concave portion 15*a* to be connected to the housing concave portion 15*a*.

The anode 11 is formed of a porous body that allows permeation of the metal solution L and supplies the metal ions to the solid electrolyte membrane 13. As a result, the metal solution L supplied from the supply path 15*b* flows through the inside of the anode 11. A portion of the metal solution L flowing through the inside of the anode 11 comes into contact with the solid electrolyte membrane 13 from the anode 11 such that the metal ions for forming the metal coating is supplied to the solid electrolyte membrane 13. Further, the metal solution L which has passed through the inside of the anode 11 is discharged from the discharge path 15*c*.

In a case where the anode 11 is an insoluble anode, the porous body constituting the anode is not particularly limited as long as the following conditions are satisfied: (1) it has corrosion resistance to the metal solution L; (2) it has conductivity so as to function as the anode; (3) it can allow the permeation of the metal solution L; and (4) it can apply pressure through the pressing unit 18 described below. For example, it is preferable that the anode 11 is a metal foam having a low oxygen overvoltage such as platinum or iridium oxide or a metal foam having high corrosion resistance such as titanium which is coated with platinum, iridium oxide, or the like. In a case where a metal foam is used, it is preferable that the metal foam has a porosity of 50 vol % to 95 vol %, a pore size of 50 μm to 600 μm, and a thickness of 0.1 mm to 50 mm.

The supply path 15*b* and the discharge path 15*c* are connected to a metal solution supply unit 21 through a pipe. The metal solution supply unit 21 supplies the metal solution L, whose metal ion concentration is adjusted to a predetermined value, to the supply path 15*b* of the housing 15 and collects the metal solution L which is discharged from the discharge path 15*c* after being used for forming the metal coating. In this way, the metal solution L can be circulated in the coating forming device 1A.

The metal solution L contains metal in the ion state of the metal coating F to be formed as described above. Examples of the metal include copper, nickel, silver, and gold. In the metal solution L, the metal is dissolved (ionized) in an acid such as nitric acid, phosphoric acid, succinic acid, nickel sulfate, or pyrophosphoric acid. For example, in a case where the metal is nickel, examples of the metal solution L include solutions of nickel nitrate, nickel phosphate, nickel succinate, nickel sulfate, nickel pyrophosphate, and the like.

The coating forming device 1A according to the embodiment includes the pressing unit 18 that is provided above the housing 15. As the pressing unit 18, for example, a hydraulic or pneumatic cylinder can be used. The pressing unit 18 is not particularly limited as long as it presses the solid electrolyte membrane 13 against the substrate B through the housing 15. As a result, the metal coating can be formed on the substrate B in a state where the surface of the substrate B is uniformly pressed by the solid electrolyte membrane 13.

Figure 2A:
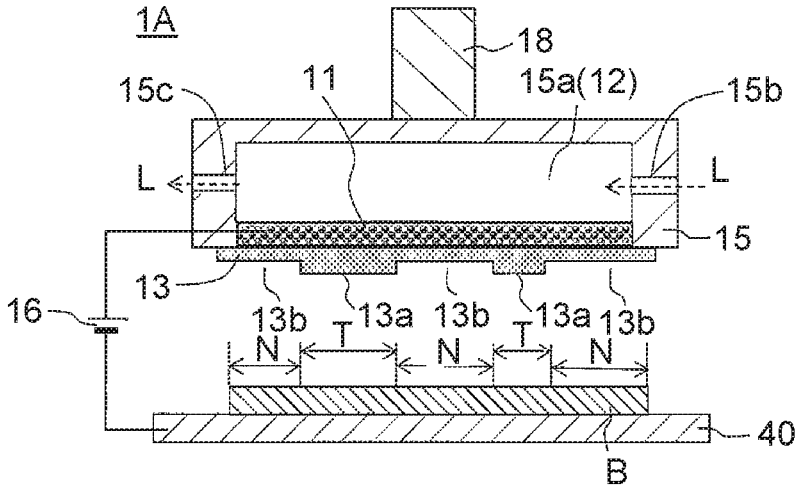
FIG. 2A is a schematic sectional view showing a state of the coating forming device before the formation of a metal coating in a coating forming method in which the coating forming device for forming a metal coating shown in FIG. 1 is used.
Figure 2B:
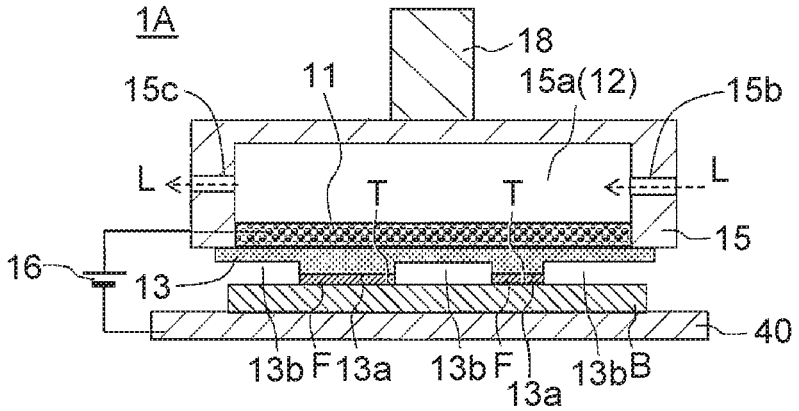
FIG. 2B is a schematic sectional view showing a state of the coating forming device during the formation of a metal coating in the coating forming method in which the coating forming device for forming a metal coating shown in FIG. 1 is used.

Here, in the embodiment, as shown in FIGS. 1, 2A, and 2B, in the solid electrolyte membrane 13, a concave portion 13*b*, which is recessed relative to the contact surface 13*a* contacting the coating-forming region T, is formed. Specifically, the concave portion 13*b* is formed such that, when the contact surface 13*a* contacts the coating-forming region T so as to cover the coating-forming region T, the solid electrolyte membrane 13 is not in contact with a portion of the surface of the substrate excluding the coating-forming region T (that is, a non-coating-forming region N of the substrate where the metal coating F is not formed).

In other words, the portion of the surface of the solid electrolyte membrane 13 opposite to the substrate B has a protrusion corresponding to the shape of the coating-forming region T of the substrate B. On this protrusion, the contact surface 13*a* which contacts the coating-forming region T so as to cover the coating-forming region T is formed. The solid electrolyte membrane 13 including the concave portion 13*b* can be formed, for example, by machining or metallic molding.

The solid electrolyte membrane 13 is not particularly limited as long as the following conditions are satisfied: the metal ions can be impregnated (contained) thereinto by bringing it into contact with the above-described metal solution L; and metal derived from the metal ions can be deposited on the surface of the substrate B when a voltage is applied thereto. Examples of the material of the solid electrolyte membrane include fluororesins, hydrocarbon resins, and polyamic acid resins such as NAFION (trade name) manufactured by DuPont; and resins having an ion exchange function such as SELEMION (CMV, CMD, CMF series) manufactured by Asahi Glass Co., Ltd.

Hereinafter, the coating forming method according to the embodiment will be described. First, as shown in FIG. 2A, the substrate B is disposed on the placing table 40. At this time, when the solid electrolyte membrane 13 is pressed against the substrate B, the coating-forming region T of the substrate B is covered with and contacts the contact surface 13*a* of the solid electrolyte membrane 13, and the substrate B is disposed at a position where the non-coating-forming region N of the substrate B is opposite to the concave portion 13*b* of the solid electrolyte membrane 13.

Next, as shown in FIG. 2B, using the pressing unit 18, the housing 15 is lowered such that the solid electrolyte membrane 13 is pressed against the substrate B. In this state, the contact surface 13*a* of the solid electrolyte membrane 13 is in contact with the coating-forming region T of the substrate B. Concurrently, the concave portion 13*b* of the solid electrolyte membrane 13 is opposite to the non-coating-forming region N of the substrate B where the metal coating is not formed (a portion of the surface excluding the coating-forming region T), and the solid electrolyte membrane 13 is not in contact with the non-coating-forming region N.

As a result, only the coating-forming region T of the substrate B is pressed by the solid electrolyte membrane 13. Therefore, the solid electrolyte membrane 13 can be made to uniformly conform to only the coating-forming region T. In the embodiment, in a state where the coating-forming region T is pressed by the solid electrolyte membrane 13, the metal coating F is formed by using the anode 11, which is pressed by the pressing unit 18, as a back-up material. Therefore, the thickness of the metal coating F can be made to be more uniform.

While maintaining the above pressed state, the metal solution supply unit 21 is driven. As a result, the metal solution L, whose metal ion concentration is adjusted to a predetermined value, can be supplied to the supply path 15*b* of the housing 15. Further, the metal solution L, which is discharged from the discharge path 15*c* after passing through the inside of the anode 11, can be supplied again (circulated) from the metal solution supply unit 21 to the container 12 of the coating forming device 1A.

Figure 3A:
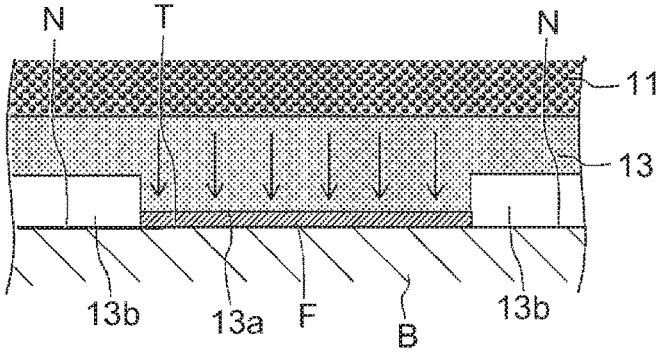
FIG. 3A is a sectional view showing the vicinity of a metal coating according to the embodiment during the formation of the metal coating.

Next, the power supply 16 applies a voltage between the anode 11 and the cathode. As shown in FIG. 3A, the metal ions contained in the solid electrolyte membrane 13 moves (refer to solid line arrows in the drawing) to the coating-forming region T (surface) of the substrate B contacting the solid electrolyte membrane 13 and are reduced on the coating-forming region T of the substrate B. As a result, metal derived from the metal ions is deposited on the coating-forming region T. On the other hand, the solid electrolyte membrane 13 is not in contact with the non-coating-forming region N of the substrate B opposite to the concave portion 13*b* of the solid electrolyte membrane 13. Therefore, metal is not deposited on the non-coating-forming region N. As a result, the metal coating F having a conspicuous edge portion can be formed on the coating-forming region T of the substrate B.

Figure 3B:
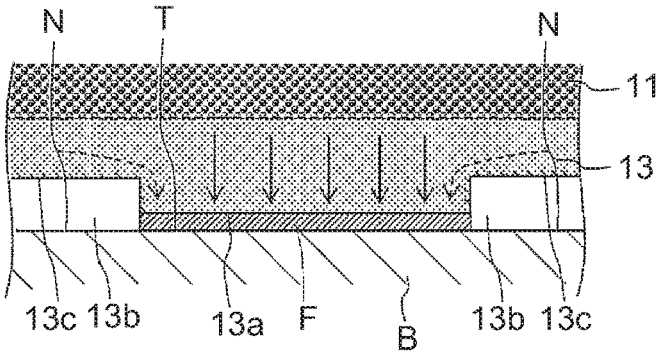
FIG. 3B is a sectional view showing the vicinity of a metal coating according to a modification example of the embodiment during the formation the metal coating.

Here, for example, in a modification example shown in FIG. 3B, a concave portion surface 13*c* on which the concave portion 13*b* of the solid electrolyte membrane 13 is formed may have higher water repellency than the contact surface 13*a*. Here, the above-described concave portion surface 13*c* can be obtained, for example, by coating the concave portion surface 13*c* with a fluorine-based coating material having higher water repellency than the material of the solid electrolyte membrane 13. As another way, for example, after masking the contact surface 13*a*, using fluorine-based gas, fluorine may be solid- solubilized only in the concave portion surface 13*c* by plasma CVD.

In this way, the concave portion surface 13*c* has water repellency. As a result, water near the concave portion 13*b* of the solid electrolyte membrane 13 is likely to move to a region near the contact surface 13*a* (refer to broken line arrows in the drawing). Therefore, water is gathered near the contact surface 13*a* of the solid electrolyte membrane 13. Therefore, the metal ions are likely to move to the region near the contact surface 13*a*, and the reduction reaction of the metal ions (deposition of metal) on the contact surface 13*a* can be smoothly performed. As a result, the deposition of metal on the coating-forming region T of the substrate B contacting the contact surface 13*a* is promoted. Therefore, the metal coating F having a conspicuous edge portion can be formed at a high coating-forming rate.

Figure 3C:
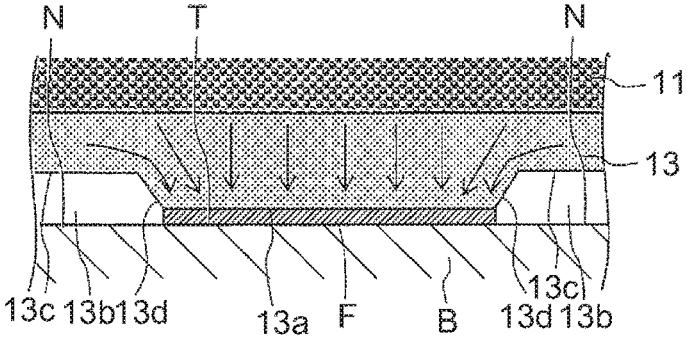
FIG. 3C is a sectional view showing the vicinity of a metal coating according to another modification example of the embodiment during the formation the metal coating.

In another modification example shown in FIG. 3C, on the concave portion surface 13*c* where the concave portion 13*b* of the solid electrolyte membrane 13 is formed, an inclined surface 13*d* that is recessed relative to the contact surface 13*a* may be formed such that a depth of the concave portion 13*b* increases from an edge portion of the contact surface 13*a* toward the inside of the concave portion 13*b*.

By providing the above-described inclined surface 13*d* on the concave portion 13*b* of the solid electrolyte membrane 13, when the substrate B is disposed below the solid electrolyte membrane to form the metal coating, the metal ions and water in the solid electrolyte membrane 13 are likely to flow near the contact surface 13*a* of the solid electrolyte membrane 13 (refer to solid line arrows in the drawing). As a result, the metal coating F can be more efficiently formed on the coating-forming region T of the substrate B.

A coating forming device 1B and a coating forming method for forming a metal coating according to a second embodiment of the invention will be described with reference to FIGS. 4A, 4B, and 5.

The coating forming device 1B according to the second embodiment is mainly different from that of the first embodiment, in that the following components are provided including: a pressure measuring unit (load cell) 17 that measures a pressure at which the solid electrolyte membrane 13 presses the substrate B; and a controller 19 that controls a pressing force of the pressing unit 18 based on a pressure signal measured by the pressure measuring unit 17. Accordingly, the same components as those in the first embodiment are represented by the same reference numerals, and the detailed description thereof will be partially omitted.

Figure 4A:
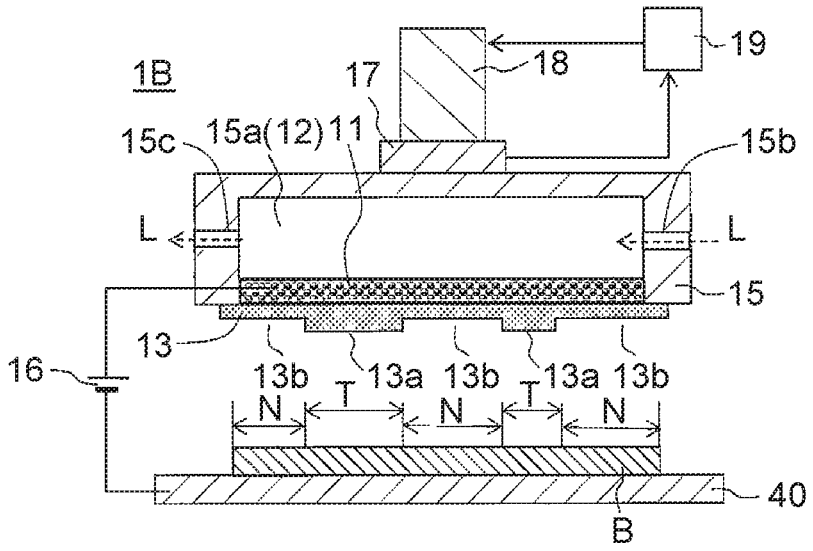
FIG. 4A is a schematic sectional view showing a state of a coating forming device for forming a metal coating according to a second embodiment of the invention before the formation of the metal coating.
Figure 5:
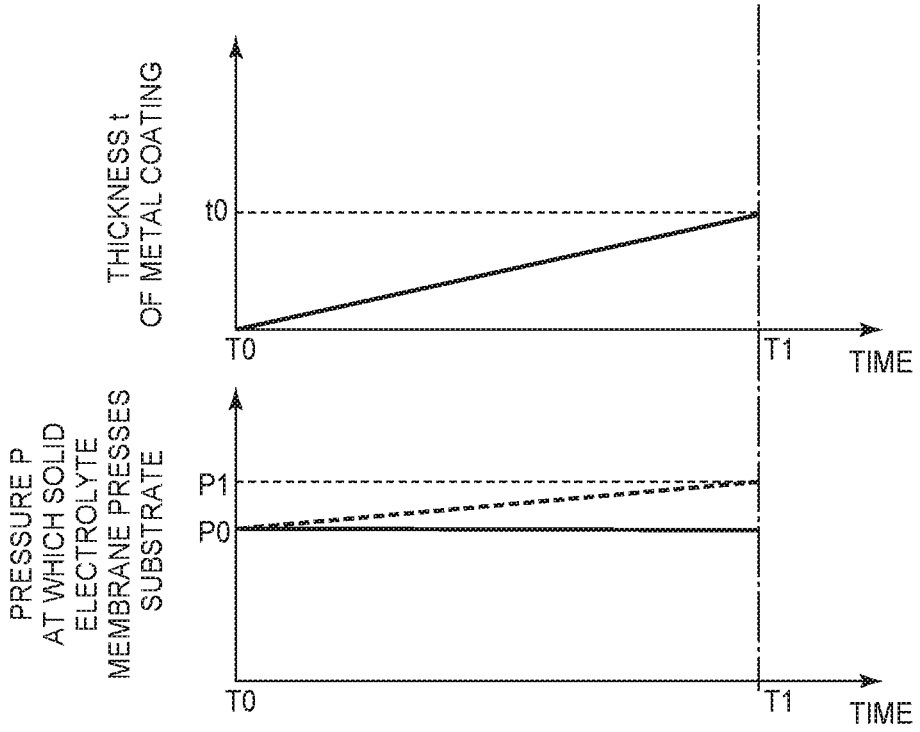
FIG. 5 is a graph showing the thickness of a metal coating and the pressure at which a solid electrolyte membrane presses a substrate.

Specifically, as shown in FIG. 4A, in the second embodiment, as in the case of the first embodiment, the pressing unit 18 that presses the solid electrolyte membrane 13 toward the substrate B is provided, and the pressure measuring unit (load cell) 17, which measures a pressure at which the solid electrolyte membrane 13 presses the substrate B, is disposed between the pressing unit 18 and the housing 15.

The pressure measuring unit 17 measures a pressure applied to the solid electrolyte membrane 13 through the housing 15. In the second embodiment, the anode 11 is fixed to the housing 15 and contacts the solid electrolyte membrane 13. Here, the pressure which can be measured by the pressure measuring unit 17 refers to the pressure applied from the substrate B side to the solid electrolyte membrane 13 (that is, the pressure at which the solid electrolyte membrane 13 presses the substrate). Specifically, this pressure is obtained by adding a pressure, at which the metal coating F pushes the solid electrolyte membrane 13 up during the formation of the metal coating F, to a pressure at which the pressing unit 18 presses the solid electrolyte membrane 13 toward the substrate B.

The controller 19 is connected to the pressure measuring unit 17 such that the pressure signal measured by the pressure measuring unit 17 is input thereto. The controller 19 is connected to the pressing unit 18 such that a control signal for controlling the pressing unit 18 is output to the pressing unit 18. Specifically, the controller 19 performs feedback-control on the pressing force, at which the pressing unit 18 presses the solid electrolyte membrane 13 toward the substrate B, such that the pressure P measured by the pressure measuring unit 17 is constant during the formation of the metal coating F.

Figure 4B:
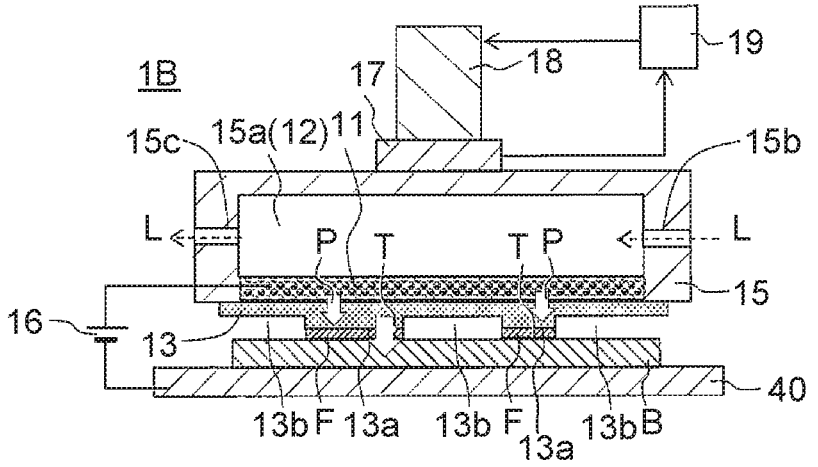
FIG. 4B is a schematic sectional view showing a state of the coating forming device for forming a metal coating according to the second embodiment of the invention during the formation of the metal coating.

When the metal coating F is formed, as shown in FIG. 4B, the pressing unit 18 allows the solid electrolyte membrane 13 to press the substrate B. At this time (time T0), in the pressure measuring unit 17, a pressure P at which the pressing unit 18 presses the solid electrolyte membrane 13 toward the substrate B is measured as a pressure P0 (refer to FIG. 5).

Here, in a case where the controller 19 does not perform feedback-control, as the formation of the metal coating F progresses, the thickness t of the metal coating F increases, and the metal coating F pushes the solid electrolyte membrane 13 up. As a result, the pressure at which the metal coating F pushes the solid electrolyte membrane 13 up is added to the pressure P0 of the pressing unit 18, and thus the pressure P at which the solid electrolyte membrane 13 presses the substrate B through the metal coating F increases (refer to a broken line in FIG. 5). At a time T1 at which the formation of the metal coating ends, the thickness t of the metal coating F reaches a thickness t0. Accordingly, the pressure P applied to the solid electrolyte membrane increases to a pressure P1 which is higher the pressure P0.

However, in the embodiment, in order to prevent such an increase in pressure, the controller 19 controls the pressing unit 18 such that the pressure measured by the pressure measuring unit 17 is the constant pressure P0 during the formation of the metal coating F. As a result, the metal coating F can be formed while controlling the pressure P, at which the substrate B is pressed toward the solid electrolyte membrane 13, to be the constant pressure P0.

Therefore, the solid electrolyte membrane 13 does not press the metal coating F at an excessive pressure during the formation of the metal coating F, and thus the shape of the contact surface 13*a* of the solid electrolyte membrane 13 can be maintained. As a result, the solid electrolyte membrane 13 can be prevented from protruding from the coating-forming region T of the substrate B and contacting with the non-coating-forming region N of the substrate B. Further, the collapse of the metal coating F during the formation of the metal coating F can be avoided. Therefore, the metal coating F having a conspicuous edge portion can be formed.

The invention will be descried using the following examples.

A metal coating was formed using the above-described coating forming device according to the first embodiment shown in FIG. 1. First, a glass plate (50 mm×50 mm×thickness 1 mm) was prepared, and gold was sputtered on a surface of the glass plate. As a result, a substrate on which a gold plating was formed was prepared. As a result, a substrate was prepared. Next, as a metal solution, 1.0 mol/L of a copper sulfate aqueous solution was prepared. As an anode, a titanium foam plate (manufactured by Mitsubishi Materials Corporation; 30 mm×30 mm×thickness 0.5 mm) having a porosity of 85% and a pore size of 50 μm was used. As a solid electrolyte membrane, an electrolyte membrane (manufactured by DuPont; NAFION N1110) having a thickness of 254 μm was used. The depth of a concave portion was 127 μtm.

Figure 6:
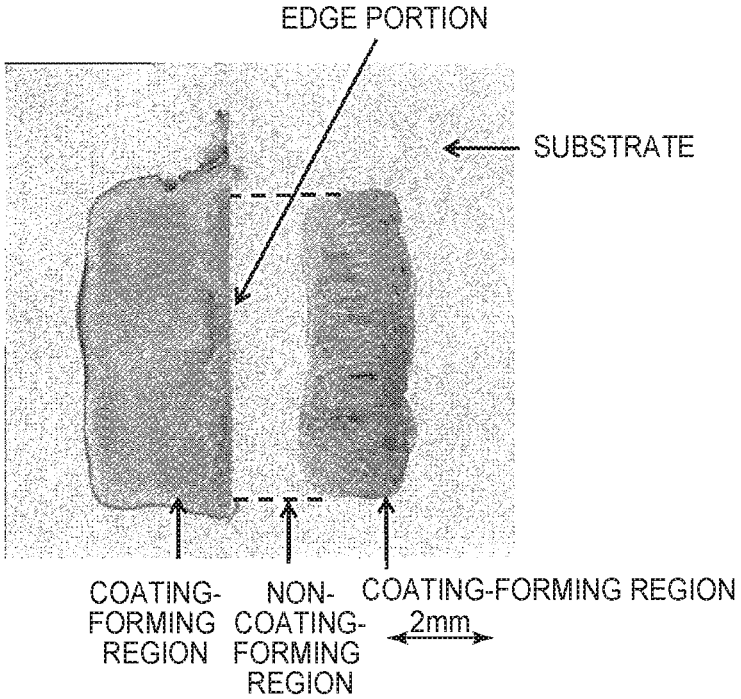
FIG. 6 is an image showing a copper coating formed on a surface of a substrate according to Example.

Next, a copper coating was formed on a surface of the gold coating of the substrate by electrically connecting the gold coating of the substrate to a negative electrode of a power supply and applying a voltage between the anode and the substrate at a current density of 2.5 $mA/cm^2$ for 5 minutes while pressing the solid electrolyte membrane against the surface of the substrate at 0.1 MPa. FIG. 6 shows an image of the obtained copper coating formed on the surface of the substrate.

As shown in FIG. 6, the copper coating was formed on a coating-forming region. In particular, in the metal coating formed on the coating-forming region on the right side of FIG. 6, an edge portion facing a non-coating-forming region was clear (conspicuous). It is considered from this result that, in Example, all the edge portions can be made to be clear by more accurately adjusting the alignment and the like between the solid electrolyte membrane and the substrate.

Hereinabove, the embodiments of the invention have been described. However, the invention is not limited to the above-described embodiments, and various design modifications can be made thereto within a range not departing from the concepts of the invention.

In the first and second embodiments, the device configuration is adopted in which the solid electrolyte membrane and the anode are brought into contact with each other by using a porous body as the anode. However, regarding the housing concave portion of the housing, another device configuration may be adopted in which the solid electrolyte membrane and the anode are separated from each other and in which the container containing the metal solution is provided between the solid electrolyte membrane and the anode. In this case, the anode may be either a porous body or a non-porous body.

What is claimed is:

1. A coating forming device for forming a metal coating on a surface of a substrate, the coating forming device comprising:

an anode;

a power supply that applies a voltage between the anode and the substrate; and a solid electrolyte membrane that is disposed between the anode and the substrate and contains metal ions, the solid electrolyte membrane including a contact surface that is a region contacting a coating-forming region, the coating-forming region being a region of a surface of the substrate where the metal coating is formed, and a concave portion that is recessed relative to the contact surface such that, when the contact surface contacts the coating-forming region, the solid electrolyte membrane is not in contact with a portion of the surface of the substrate excluding the coating-forming region, the metal ions being reduced to form the metal coating on the coating-forming region by the power supply applying a voltage between the anode and the substrate in a state where the contact surface is in contact with the substrate, wherein water repellency of a surface of the concave portion is higher than water repellency of the contact surface.

2. The coating forming device according to claim 1, wherein the surface of the concave portion includes an inclined surface that is inclined relative to the contact surface such that a depth of the concave portion increases from an edge portion of the contact surface toward an inside of the concave portion.

3. The coating forming device according to claim 1, further comprising:

a pressing unit configured to press the solid electrolyte membrane toward the substrate;

a pressure measuring unit configured to measure a pressure at which the solid electrolyte membrane presses the substrate; and a controller configured to control the pressing unit such that a pressure measured by the pressure measuring unit is constant during a formation of the metal coating.

4. A coating forming device for forming a metal coating on a surface of a substrate, the coating forming device comprising:

an anode;

a power supply that applies a voltage between the anode and the substrate; and a solid electrolyte membrane that is disposed between the anode and the substrate and configured to contain metal ions, the solid electrolyte membrane including a contact surface that is a region contacting a coating-forming region, the coating-forming region being a region of a surface of the substrate where the metal coating is formed, and a concave portion that is recessed relative to the contact surface such that, when the contact surface contacts the coating-forming region, the solid electrolyte membrane is not in contact with a portion of the surface of the substrate excluding the coating-forming region, the metal ions being reduced to form the metal coating on the coating-forming region by the power supply applying a voltage between the anode and the substrate in a state where the contact surface is in contact with the substrate, wherein the anode is a porous body that allows permeation of a solution containing the metal ions and is configured to supply the solution containing the metal ions to the solid electrolyte membrane, and the solid electrolyte membrane is further configured to be impregnated by the metal ions of the solution that is supplied by the anode, and water repellency of a surface of the concave portion is higher than water repellency of the contact surface.

5. The coating forming device according to claim 4, wherein the surface of the concave portion includes an inclined surface that is inclined relative to the contact surface such that a depth of the concave portion increases from an edge portion of the contact surface toward an inside of the concave portion.

6. The coating forming device according to claim 4, further comprising:

a pressing unit configured to press the solid electrolyte membrane toward the substrate;

a pressure measuring unit configured to measure a pressure at which the solid electrolyte membrane presses the substrate; and a controller configured to control the pressing unit such that a pressure measured by the pressure measuring unit is constant during a formation of the metal coating.

7. A coating forming method for forming a metal coating, the coating forming method comprising:

contacting a solid electrolyte membrane toward a substrate, the solid electrolyte membrane configured to be impregnated by metal ions and being disposed between an anode that is a porous body that allows permeation of a solution, containing the metal ions, and the substrate; and supplying the solution containing the metal ions to the anode, such that the solution permeates through the anode and the metal ions impregnate the electrolyte membrane; and forming the metal coating on a surface of the substrate by applying a voltage between the anode and the substrate to reduce the metal ions, the solid electrolyte membrane including a contact surface and a concave portion, and the concave portion being recessed relative to the contact surface such that, when the contact surface contacts a coating-forming region of the surface of the substrate where the metal coating is formed, the solid electrolyte membrane is not in contact with a portion of the surface of the substrate excluding the coating-forming region, wherein water repellency of a surface of the concave portion is higher than water repellency of the contact surface.

8. The coating forming method for forming a metal coating according to claim 7, wherein the surface of the concave portion includes an inclined surface that is inclined relative to the contact surface such that a depth of the concave portion increases from an edge portion of the contact surface toward an inside of the concave portion, and the substrate is disposed below the solid electrolyte membrane during a formation of the metal coating.

9. The coating forming method for forming a metal coating according to claim 7, wherein the substrate is pressed toward the solid electrolyte membrane during a formation of the metal coating, and a pressure at which the substrate is pressed toward the solid electrolyte membrane is controlled to be constant during the formation of the metal coating.

* * * * *